US008847728B2

(12) United States Patent
Gorny et al.

(10) Patent No.: US 8,847,728 B2
(45) Date of Patent: Sep. 30, 2014

(54) DOMESTIC APPLIANCE COMPRISING A MEASURING UNIT AND METHOD FOR TRANSMITTING A MEASUREMENT VARIABLE

(75) Inventors: Piotr Gorny, Syców (PL); Lothar Knopp, Berlin (DE); Guido Sattler, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 469 days.

(21) Appl. No.: 13/128,906

(22) PCT Filed: Nov. 13, 2009

(86) PCT No.: PCT/EP2009/065138

§ 371 (c)(1),
(2), (4) Date: May 12, 2011

(87) PCT Pub. No.: WO2010/063554

PCT Pub. Date: Jun. 10, 2010

(65) Prior Publication Data

US 2011/0218652 A1 Sep. 8, 2011

(30) Foreign Application Priority Data

Dec. 3, 2008 (DE) ..... 10 2008 044 324

(51) Int. Cl.
*G05B 11/01* (2006.01)
*D06F 58/28* (2006.01)

(52) U.S. Cl.
CPC ..... *D06F 58/28* (2013.01); *D06F 2058/2838* (2013.01)
USPC ..... 340/3.1; 340/604; 34/528; 324/664; 324/694

(58) Field of Classification Search
CPC ..... D06F 58/28; D06F 2058/2896; D06F 2058/2816; G01N 27/223; G01N 27/048
See application file for complete search history.

(56) References Cited

U.S. PATENT DOCUMENTS

| | | | | |
|---|---|---|---|---|
| 6,112,579 | A | 9/2000 | Tryba | |
| 7,345,491 | B2 * | 3/2008 | Pezier | 324/694 |
| 2005/0278974 | A1 * | 12/2005 | Chung | 34/528 |
| 2007/0273205 | A1 * | 11/2007 | Aoyama | 307/3 |

FOREIGN PATENT DOCUMENTS

| | | | | |
|---|---|---|---|---|
| DE | 19808839 | C1 | 7/1999 | |
| EP | 0940494 | A1 * | 9/1999 | D06F 58/28 |
| EP | 1087053 | B1 | 3/2001 | |
| EP | 1816253 | B1 | 8/2007 | |
| WO | 2004022836 | A2 | 3/2004 | |

OTHER PUBLICATIONS

International Search Report.

* cited by examiner

*Primary Examiner* — Benjamin C Lee
*Assistant Examiner* — Rajsheed Black-Childress
(74) *Attorney, Agent, or Firm* — Nixon & Vanderhye, P.C.

(57) ABSTRACT

A method and apparatus for transmitting a measurement variable that is detected by a measuring unit and transmitted via a data transmission channel to a main control unit of a domestic appliance that is isolated from the measuring unit is disclosed. The measurement control unit is coupled to the main control unit via a data transmission channel through which a measurement variable detectable by the measuring unit can be transmitted to the main control unit. The data transmission channel is a line having a protective impedance.

21 Claims, 2 Drawing Sheets

DOMESTIC APPLIANCE COMPRISING A MEASURING UNIT AND METHOD FOR TRANSMITTING A MEASUREMENT VARIABLE

This application is a U.S. National Phase of International Application No. PCT/EP2009/65138, filed Nov. 13, 2009, which designates the U.S. and claims priority to German Application No. 102008044324.7, filed Dec. 3, 2008, the entire contents of each of which are hereby incorporated by reference.

BACKGROUND OF THE INVENTION

The invention relates to a domestic appliance comprising a main control unit and a measuring unit insulated from the main control unit and having a measurement control unit which is coupled to the main control unit via a data transmission channel via which a measurement variable detectable by the measuring unit can be transmitted to the main transmission channel. The invention further relates to a method for transmitting a measurement variable which is detected by means the measurement unit in a domestic appliance and is transmitted from a measurement control unit of the measurement unit via a data transmission channel to a main control unit of the domestic appliance insulated from the measurement unit.

Such a domestic appliance and such a method are already known from the prior art. Publication DE 198 08 839 C1 discloses a tumble dryer with a main control unit and a measurement unit electrically isolated from the main control unit. This represents a conductivity sensor with which the conductivity of items of laundry accommodated in a drum is able to be detected. The conductivity detected by the conductivity sensor is transmitted in such cases via a wireless transmission channel to the main control unit. The significant aspect is that the transmission channel is formed by an optocoupler through which the wireless data transmission between the conductivity sensor and the main control unit is guaranteed.

A tumble dryer is known from publication DE 102 42 144 A1, the drum of which features a sensor device for determining a degree of moisture in items of laundry. In this invention the sensor device communicates with a control unit via a non-contact or wireless transmission channel. The transmission can for example use light signals or be radio transmission.

By using wireless transmission, such as optocouplers in particular, account is taken of the requirements in respect of electrical isolation. However, in the known solutions, especially with the use of an optocoupler for data transmission, the situation is to be seen as disadvantageous that such semiconductor components are especially susceptible to interference from interference pulses, such as typically occur through electrostatic discharges in domestic appliances.

BRIEF SUMMARY OF THE INVENTION

The object of the invention is to create a domestic appliance and also a method of the type stated at the outset in which an especially robust data transmission between the measurement control unit and the main control unit is guaranteed, in which case the requirements in respect of electrical potential isolation are to be satisfied.

This object is inventively achieved by a domestic appliance as well as by a method with the features of the respective independent claim. Preferred embodiments of the invention are specified in the dependent claims, with preferred embodiments of the domestic appliance corresponding to preferred embodiments of the method and vice versa, and this is also the case if not explicitly stated herein.

An inventive domestic appliance comprises a main control unit and a measurement unit insulated or electrically isolated from the main control unit. The measurement unit has a measurement control unit which is coupled by a data transmission channel to the main control unit. A measurement variable able to be detected by the measurement unit, especially by means of a sensor, is able to be transmitted to the main control unit via the data transmission channel. Inventively there is provision for the data transmission channel to be formed by a line having a protective impedance.

Thus, in accordance with the invention, a domestic appliance is provided in which the data is transmitted by wire between the measurement control unit and the main control unit via a protective impedance. Data transmission thus does without an optocoupler and is thus not susceptible to interference pulses, especially to electrostatic discharges. Furthermore the protective impedance guarantees a potential isolation between the measurement unit and the main control unit, through which the requirements for operational safety are met. The measurement unit can thus also be referred to as a "measurement island".

The fact that the protective impedance is not assigned to the actual measurement circuit, especially not inserted into the latter, but is assigned to the line used for the transmission of the data which represents the results of the measurement, means that any adverse effect on the measurement itself through the protective impedance or because of it is excluded.

In accordance with one form of embodiment there is provision for the protective impedance to feature a highpass filter coupling the measurement control unit with the main control unit. The protective impedance then features a reactance and interference pulses or direct currents occurring in the transmission channel can be suppressed. The use of a highpass filter thus makes it possible to transmit a high-frequency data signal, such as a digital signal for example, and further ensures electrical isolation or potential barriers respectively between the measurement unit and the main control unit.

The highpass filter in this case can have a limited frequency of greater than 50 Hz, preferably greater than 70 Hz, more preferably greater than 100 Hz. It is thus guaranteed that the limited frequency of the highpass filter is sufficiently greater than the frequency of the interference voltage, i.e. the mains voltage for example.

The protective impedance preferably features a capacitance through which the highpass filtering is guaranteed. In this case there is especially provision for the highpass filter to feature a capacitor coupling the measurement control unit to the main control unit or a plurality of series-connected capacitors. The highpass filter is then formed by the capacitor or the plurality of capacitors. The use of a capacitor in this case enables an especially reliable highpass filter to be created without great effort which, especially in respect to robust data transmission which is not susceptible to interference, proves especially advantageous.

The measurement unit is preferably embodied for generating a data signal characterizing the measurement variable, especially a digital signal, as a function of a measurement signal. The measurement signal can be provided for example with a sensor and be transmitted to the measurement control unit, which then creates the data signal, especially the digital signal, as a function of the measurement signal and transfers it via the highpass filter to the main control unit. The data signal which is generated by the measurement control unit can be a modulated or bit-encoded digital signal. A digital frequency modulation or a bi-phase encoding can typically be used. The data signal preferably further features a direct current component (DC component) equal to zero.

On the receive side a decision unit, especially a trigger, can be provided for processing the received digital signal. The decision unit can be connected upstream from the main control unit or integrated into the latter in this case. With the decision unit, especially the trigger, the digital signal received, and smoothed and damped by transmission via the highpass filter can be converted into a processable signal which is then evaluated by means of the main control used in respect to the measurement variable. The decision unit, especially the trigger, thus preferably provides a bit stream for the main control unit, of which the bits are generated as a result of a decision or evaluation of the received smoothed digital signal. The decision unit, especially the trigger, thus increases the accuracy in the evaluation of the digital signal and thus in the detection of the measurement variable by the main control unit.

In accordance with a form of embodiment alternate to the highpass filter there is provision for the protective impedance to feature an active resistor coupling the measurement control unit and the main control unit, by which a data signal characterizing the measurement variable, especially a digital signal, is able to be transmitted to the main control unit. In this case a reference line running in parallel to the protective impedance is provided, by which a reference signal is able to be transmitted in parallel to the data signal, especially the digital signal. In this form of embodiment the protective impedance thus features one or more resistors connected in series which form the data transmission channel between the measurement control unit and the lane control unit. In this manner robust data transmission between the measurement unit and the main control unit can be guaranteed without great effort with simultaneous potential isolation.

The measurement unit is preferably embodied to provide a DC voltage as the reference signal, of which the value is equal to the direct current component of the data signal to be transmitted by the data transmission channel, especially the digital signal. Thus on the receive side the data signal and also the DC voltage which is equal to the direct current component of the data signal are available on the receive side, which can be evaluated by means of the main control unit in respect of the measurement variable. In this case it has been shown to be especially advantageous for a comparator to be provided which is embodied for generating the evaluation signal as a function of the difference between the data signal, especially the digital signal, and the reference signal. The main control unit is then embodied for evaluating the evaluation signal in respect of the measurement variable. The comparator in this case can be connected upstream of the main control unit or integrated into the latter. By using the comparator, by means of which the data signal transmitted via the data transmission channel and the reference signal are compared, interference on the mains voltage can be successfully suppressed. The data signal transmitted via the transmission channel as well as the reference signal are namely attenuated by the protective impedance such that the signal level generated by the interference voltage, such as the mains voltage for example, does not overload the comparator. Since the interference signal is always present at the same polarity at both inputs of the comparator and only the difference between the signals at the inputs of the comparators is detected, the interference signal is rejected. This rejection is also referred to as common-mode-rejection.

In this form of embodiment in which the protective impedance or the data transmission channel respectively is formed by an active resistor, the measurement unit can typically provide a serial digital signal or a bit stream which is then transmitted via the data transmission channel as a data signal. An advantage of this form of embodiment consists of the transmission bandwidth essentially extending from zero (DC) to the physical limits of the components, i.e. the measurement control unit and the main control unit.

Both in the first and also in the second alternative the domestic appliance can be embodied as a domestic appliance for care of laundry items, with the measurement unit preferably being embodied for detecting a laundry-related variable, especially a conductivity of items of laundry inserted into the drum of the domestic appliance. Thus the detected conductivity is transmitted protectively-insulated to the main control unit of the domestic appliance from the measurement unit, and the main control unit can control the operation of the domestic appliance, for example the drying process, as a function of the detected conductivity. With the tumble dryer in particular information can thus be obtained in respect of the current level of moisture or level of drying of items of laundry.

In an inventive method a measurement variable is detected by means of a measurement unit in a domestic appliance and transmitted from a measurement control unit of the measurement unit via a data transmission channel to a main control unit of the domestic appliance insulated from the measurement unit. In this case the measurement variable is transmitted to the main control unit via a line featuring a protected impedance.

In the method a data signal characterizing the measurement variable, especially a digital signal, is generated by means of the measurement unit and transmitted via a highpass filter of the data transmission channel to the main control unit.

As an alternative, a data signal characterizing the measurement variable, especially a digital signal, will be generated by means of the measurement unit and transmitted via an active resistor of the data transmission channel to the main control unit. In this case a reference signal is preferably transmitted in parallel to the data signal, especially to the digital signal, via a reference line, and an evaluation signal is generated as a function of a difference between the data signal and the reference signal by means of a comparator. The comparator is connected upstream from the main control unit or is integrated into the latter.

The preferred exemplary embodiments explained with reference to the inventive domestic appliance and their advantages apply correspondingly to the inventive method.

Further features of the invention emerge from the claims, the figures and the figure description. The features and combinations of features cited here in the description as well as the features and combinations of features given on their own below in the figure description and/or in the figures are able to be used not only in the respectively specified combination but also in other combinations and also in isolation, without departing from the framework of the invention.

BRIEF DESCRIPTION OF THE DRAWINGS

The invention will now be explained with reference to individual preferred exemplary embodiments as well as written reference to the enclosed drawing, in which.

DETAILED DESCRIPTION OF EXEMPLARY EMBODIMENTS OF THE PRESENT INVENTION

Figure 1:
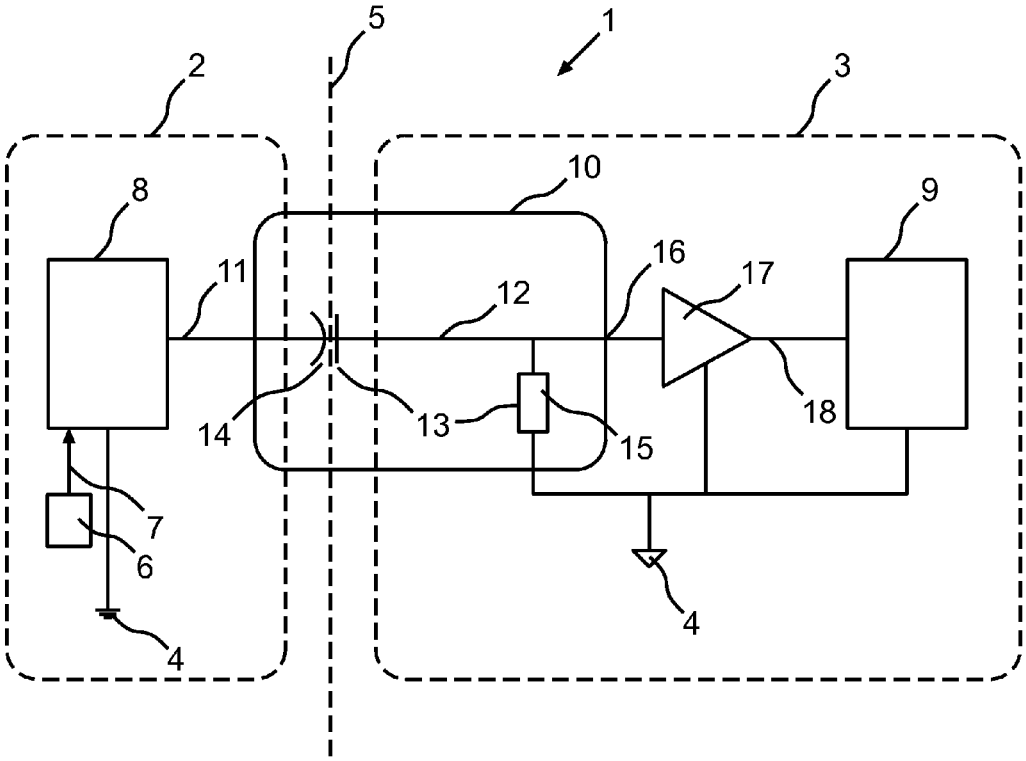
FIG. 1 shows a schematic diagram of a data transmission system of a domestic appliance in accordance with a first form of embodiment.

Identical elements or elements with the same functions are provided with the same reference characters in the figures.

FIG. 1 shows a data transmission system 1 in accordance with a first exemplary embodiment. The data transmission system 1 is arranged in a domestic appliance, for example in a tumble dryer, and is used for detecting and transmitting a conductivity of items of laundry arranged in a drum of the domestic appliance.

The data transmission system 1 features a measurement unit or measurement island 2 as well as a circuit arrangement 3 for controlling the domestic appliance. In this case the measurement unit 2 is electrically isolated from the circuit arrangement 3 or the measurement unit 2 and the circuit arrangement 3 have different reference potentials 4. A potential barrier between the measurement unit 2 and the circuit arrangement 3 is indicated by a dashed line 5 in FIG. 1. It should be mentioned here that the measurement unit 2 represents a protectively insulated part and the circuit arrangement 3 represents a part of the data transmission system 1 susceptible to mains voltage.

The measurement unit 2 features a conductivity sensor 6 which is embodied for detecting the conductivity of items of laundry. The conductivity sensor 6 generates a measurement signal 7 which characterizes the conductivity detected. The measurement signal 7 is transmitted by the conductivity sensor 6 to a measurement control unit 8 of the measurement unit 2.

The circuit arrangement 3 comprises a main control unit 9 which is embodied for controlling and/or regulating processes of the domestic appliance. The conductivity of laundry items detected by means of the conductivity sensor 6 is now to be transferred from the measurement unit 2 to the main control unit 9. A data transmission channel 10 is provided for this purpose, via which the conductivity, or to put it more precisely a data signal 11 characterizing the conductivity, is transmitted. In this case the data signal 11 is generated by means of the measurement control unit 8 is a function of the measurement signal 7. The data signal 11 is provided in the following example as a digital signal, for example as a bit-encoded digital signal.

The data transmission channel 10 is formed by a line 12 featuring a protective impedance 13. In the present example the data transmission channel 10 features a highpass filter 13, which is formed by a capacitor 14 connecting the measurement control unit 8 and the main control unit 9 as well as by an holmic resistor 15. The holmic resistor 15 in this case is connected to reference potential 4 of the circuit arrangement 3, so that the highpass filter 13 is provided as an RC highpass.

The capacitor 14 is dimensioned such that the limit frequency of the highpass filter 13 is greater than 50 Hz, especially greater than 100 Hz, than the frequency of the mains voltage to which the domestic appliance is connected. In this way it is achieved that only the digital signal 11, which accordingly has a frequency greater than 50 Hz, and not the mains voltage can be transmitted via the data transmission channel 10.

The digital signal 11 is modulated or encoded by means of the measurement control unit 8 such that its DC component amounts to zero. The digital signal 11 is then transferred by the data transmission channel 10, to put it more precisely by the highpass filter 13 and is thus transferred to the main control unit 9. The highpass filter 13 however sets a distorted digital signal 11 at its output 16, so that a corresponding conditioning of the digital signal 11 is required. To this end a decision unit 17 is connected upstream of the main control unit 9, which is embodied for processing the received digital signal 11. The decision unit 17 can for example be provided as a trigger or as a comparator, at the inputs of which a digital signal 11 on the one hand and the reference potential 4 on the other hand are present. The decision unit 17 provides an evaluation signal 18 which is transferred directly to the main control unit 9. The evaluation signal 18 in this case essentially represents an ideal digital signal or an ideal bit stream respectively. The main control unit 9 now evaluates the evaluation signal 18 in respect of the conductivity of items of laundry.

Figure 2:
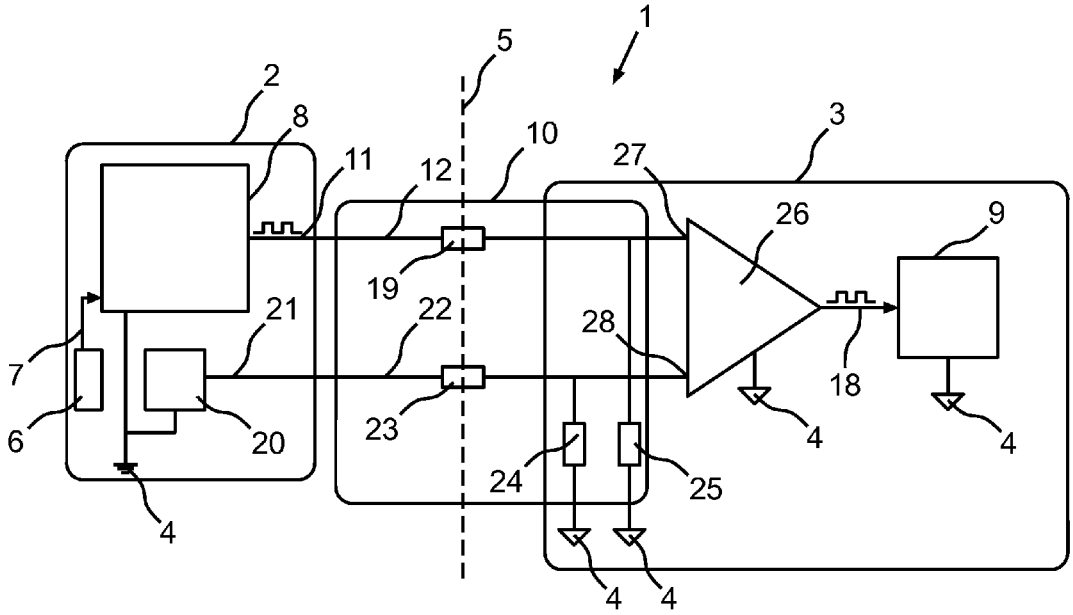
FIG. 2 shows a schematic diagram of a data transmission system of a domestic appliance in accordance with the second form of embodiment.

A data transmission system 1 in accordance with a second exemplary embodiment is shown in FIG. 2. Here too the measurement unit 2 is electrically isolated from the circuit arrangement 3 including the main control unit 9, with a potential barrier being indicated by a dashed line 5. In the second exemplary embodiment of the data transmission channel 10 is formed in a similar manner to the first exemplary embodiment by a protective impedance 19, which now however features an active resistance 19. A data signal 11, especially a serial digital signal which is generated by means of the measurement control unit 8 as a function of the measurement signal 7, is transmitted via the active resistance 19.

In the second exemplary embodiment the measurement unit 2 further features a reference unit 20 which is embodied for providing a reference signal 21. Although in the present example the reference unit 20 is shown as a separate unit from the measurement control unit 8, it can however be integrated into the measurement control unit 8. The reference signal 21 is provided here as a DC voltage the value of which is equal to a DC component of the digital signal 11. The reference signal 21 is transferred in this case by a reference line 22 to the circuit arrangement 3. The reference line 22 features a resistor 23 which, with a resistor 24 connected against reference potential 4, forms a voltage divider. Similarly an additional resistor 25 is functionally assigned to the active resistor 19 such that a voltage divider is formed with the resistors 19, 25.

The circuit arrangement 3 includes a comparator 26 in the second exemplary embodiment which is connected upstream of the main control unit 9 and which is embodied for generating an evaluation signal 18 to the main control unit 9. In this case the comparator 26 is supplied at a first input 27 with the digital signal 11 and at a second input 28 with the reference signal 21. The comparator 26 thus generates the evaluation signal 18 as a function of the difference between a digital signal 11 and the reference signal 21 or the evaluation signal 18 represents the difference between a digital signal 11 and the reference signal 21.

Both the digital signal 11 also the reference signal 21 are affected by an interference signal, such as by the mains voltage for example. Since the interference signal is present with the same polarity at both inputs 27, 28 of the comparator 26, the interference signal is suppressed and only the difference between a digital signal 11 and the reference signal 21 is detected by means of the comparator 26. Thus the data transmission over the data transmission channel 10 is not adversely affected by the mains voltage, and the measurement unit 2 remains electrically isolated from the circuit arrangement 3.

The invention claimed is:

1. A domestic appliance comprising:

a main control unit susceptible to mains voltage;

a measurement unit electrically isolated from the main control unit, the measurement unit being protectively insulated from the mains voltage supplied to the main control unit, the measurement unit having a measurement control unit; and a data transmission channel coupling said measurement control unit to the main control unit, said data transmission channel being adapted to transmit a measurement variable that can be detected by the measurement unit to the main control unit, via a line having a protective impedance providing said data transmission channel, said protective impedance providing potential isolation between the measurement unit and the main control unit, such that the mains voltage cannot be transmitted via the data transmission channel.

2. The domestic appliance of claim 1, further comprising:

a highpass filter coupling the measurement control unit to the main control unit, said highpass filter providing said protective impedance.

3. The domestic appliance of claim 2, wherein the highpass filter has a limit frequency greater than 50 Hz.

4. The domestic appliance of claim 2, wherein the highpass filter includes a capacitor coupling the measurement control unit to the main control unit.

5. The domestic appliance of claim 2, further comprising:

a sensor that generates a data signal characterizing the measurement variable as a measurement signal of the sensor, said data signal being adapted to be transmitted via a highpass filter.

6. The domestic appliance of claim 5 wherein the data signal is a digital signal.

7. The domestic appliance of claim 2, wherein the measurement unit generates the data signal, said data signal having a DC component equal to zero.

8. The domestic appliance of claim 7 wherein the data signal is a digital signal.

9. The domestic appliance of claim 5, further comprising:

a decision unit adapted for processing the received data signal.

10. The domestic appliance of claim 5 wherein the decision unit is a trigger and the received data signal is a digital signal.

11. The domestic appliance of claim 1, further comprising:

an active resistor coupling the measurement control unit to the main control unit, said active resistor being adapted to transmit the data signal characterizing the measurement variable to the main control unit, said active resistor providing protective impedance; and a reference line connected in parallel to the protective impedance and adapted to transmit a reference signal in parallel to the data signal.

12. The domestic appliance of claim 11 wherein the reference signal is a DC voltage reference signal having a value equal to the DC component of the data signal.

13. The domestic appliance of claim 11, further comprising:

a comparator adapted to generate an evaluation signal using the difference between the data signal and the reference signal, said main control unit being adapted for evaluating the measurement variable using the evaluation signal.

14. The domestic appliance of claim 1 wherein the domestic appliance is a domestic appliance for the care of items of laundry and said measuring unit detects a laundry-related measurement variable.

15. The domestic appliance of claim 1 wherein the domestic appliance is a domestic appliance for the care of items of laundry having a drum and said measuring unit detects the conductivity of items of laundry inserted into the drum.

16. A method for transmitting a signal characterizing a measurement variable from a measurement unit to a main control unit electrically isolated from the measurement unit in a domestic appliance, said method comprising the steps of:

applying mains voltage to the main control unit;

using the measurement unit to detect the measurement variable; and using a line having a protective impedance to transmit the measurement variable from a measurement control unit of the measurement unit through a data transmission channel to the main control unit, said protective impedance providing potential isolation between said main control unit and the measurement unit of the domestic appliance such that the mains voltage cannot be transmitted via the data transmission channel.

17. The method of claim 16, further comprising the step of:

transmitting the data signal characterizing the measurement variable detected by the measurement unit, through a highpass filter of the data transmission channel to the main control unit.

18. The method of claim 17 wherein the data signal is a digital signal.

19. The method of claim 16, further comprising the steps of:

transmitting the data signal to the main control unit through an active resistance in the data transmission channel;

transmitting a reference signal through a reference line in parallel to the data signal; and providing an evaluation signal as a function of a difference between the data signal and the reference signal at the main control unit using a comparator.

20. The domestic appliance of claim 1 wherein the frequency of the protective impedance is greater than the frequency of the mains voltage.

21. The domestic appliance of claim 2, wherein the highpass filter has a limit frequency greater than 70 Hz.

* * * * *